US008950807B2

(12) United States Patent
Lerm

(10) Patent No.: US 8,950,807 B2
(45) Date of Patent: Feb. 10, 2015

(54) FUNCTIONAL SEAT COVER

(76) Inventor: Claudia Lerm, Veithshochheim (DE)

( * ) Notice: Subject to any disclaimer, the term of this patent is extended or adjusted under 35 U.S.C. 154(b) by 87 days.

(21) Appl. No.: 13/388,524

(22) PCT Filed: Aug. 6, 2010

(86) PCT No.: PCT/DE2010/000923

§ 371 (c)(1),
(2), (4) Date: Mar. 21, 2012

(87) PCT Pub. No.: WO2011/015195

PCT Pub. Date: Feb. 10, 2011

(65) Prior Publication Data

US 2012/0187732 A1 Jul. 26, 2012

(30) Foreign Application Priority Data

Aug. 6, 2009 (DE) ..... 10 2009 036 400

(51) Int. Cl.

| | |
|---|---|
| ***A47C 31/00*** | (2006.01) |
| ***A47C 31/11*** | (2006.01) |
| ***A47C 7/74*** | (2006.01) |
| ***A47D 1/00*** | (2006.01) |

(52) U.S. Cl.

CPC ..... *A47C 31/11* (2013.01); *A47C 7/744* (2013.01); *A47C 7/748* (2013.01); *A47C 31/006* (2013.01); *A47D 1/00* (2013.01)

USPC ..... 297/219.12; 297/228; 297/188.15

(58) Field of Classification Search

USPC ..... 297/219.12, 227, 228, 188.14, 188.15

See application file for complete search history.

(56) References Cited

U.S. PATENT DOCUMENTS

| | | | | |
|---|---|---|---|---|
| 2,254,466 | A | 9/1941 | Albert | 155/182 |
| 5,678,888 | A | 10/1997 | Sowell et al. | 297/256.17 |
| 5,833,309 | A * | 11/1998 | Schmitz | 297/219.12 X |
| 6,428,098 | B1 | 8/2002 | Allbaugh | 297/219.12 |
| 2006/0012228 | A1 | 1/2006 | Bardouche | 297/228.12 |
| 2008/0150334 | A1 | 6/2008 | Callaghan | 297/218.3 |

FOREIGN PATENT DOCUMENTS

| | | | |
|---|---|---|---|
| FR | 2828799 | A1 | 2/2003 |
| GB | 944187 | A | 12/1963 |
| JP | 2003235690 | A | 8/2003 |

OTHER PUBLICATIONS

International Search Report for PCT Application No. PCT/DE2010/000923, dated Dec. 8, 2010, 6 pages.

(Continued)

*Primary Examiner* — Anthony D Barfield

(74) *Attorney, Agent, or Firm* — Westman, Champlin & Koehler, P.A.

(57) ABSTRACT

The invention relates to a functional seat cover for placing on seating, in particular for children, comprising an approximately horizontal seat, an approximately vertical backrest, and two armrests, composed of washable textile material, wherein a quadrilateral seat surface can be placed on the seat, wherein the first edge of the seat surface is connected to a rear part, on which a backrest hood is formed, which backrest hood can be pulled over the back rest, and the second edge and fourth edge of the seat surface lying opposite each other are each connected to one armrest part, wherein each armrest part can be paced on an armrest, and the third edge of the seat surface is connected to a foot part, which can be suspended over the front edge of the seat.

17 Claims, 2 Drawing Sheets

(56) References Cited

OTHER PUBLICATIONS

Figure 1:
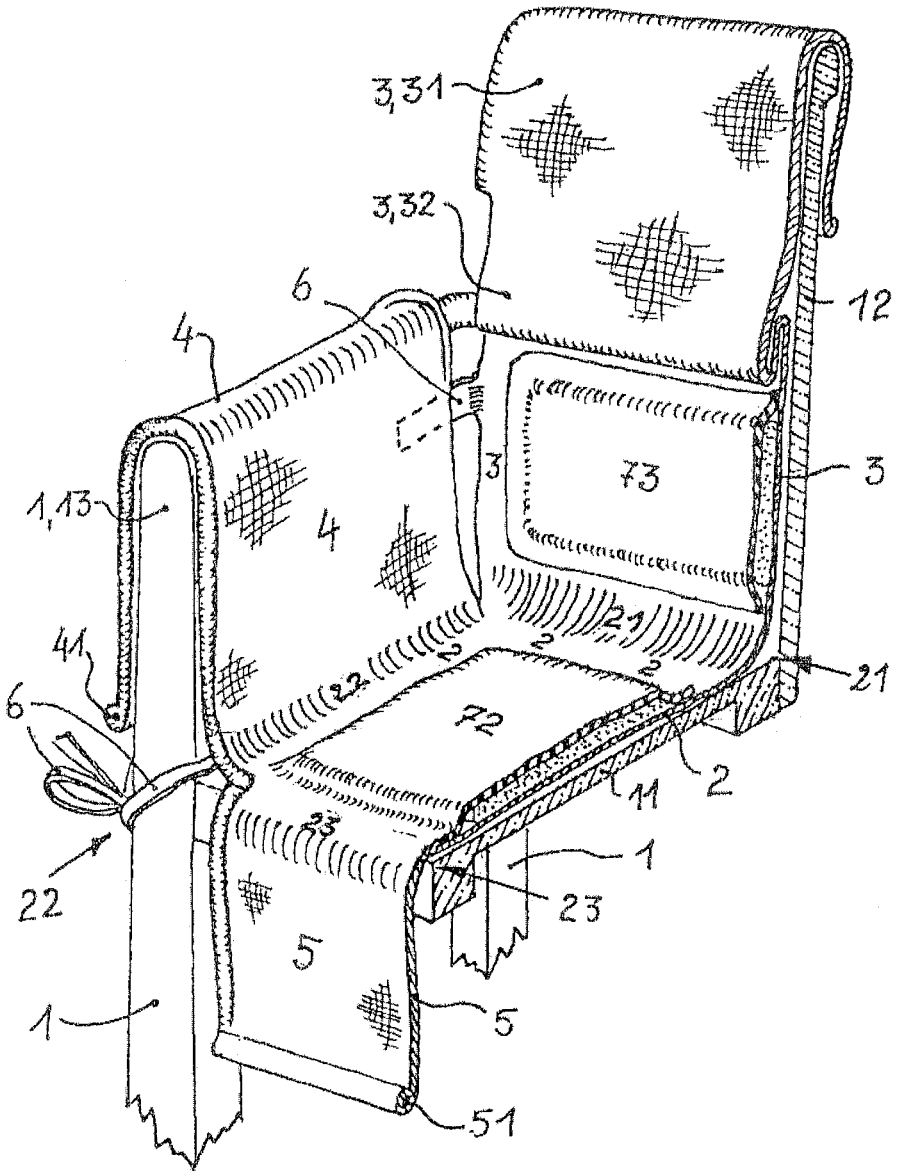

International Preliminary Report on Patentability for PCT Application No. PCT/DE2010/000923, dated Feb. 7, 2012, 2 pages.

Written Opinion (with English translation) for International Search Report for PCT Application No. PCT/DE2010/000923, dated Dec. 8, 2010, 13 pages.

* cited by examiner

FUNCTIONAL SEAT COVER

CROSS-REFERENCE TO RELATED APPLICATION

This Application is a Section 371 National Stage Application of International Application No. PCT/DE2010/000923, filed Aug. 6, 2010 and published as WO 2011/015195 Al on Feb. 10, 2011, in German, the contents of which are hereby incorporated by reference in their entirety.

The invention relates to a functional seat cover for placing on seating, in particular for children, comprising an approximately horizontal seat, an approximately vertical backrest, and two armrests, composed of washable textile material.

In the prior art, a very large number of variations on seats are known. In principle, each seat consists of an approximately horizontal seat, on which the buttocks of a person rest. In the development that is of interest here, a backrest is adjoined on one edge of this seat and an armrest in each case on the two adjacent edges. The sitting person rests his back against the backrest and can rest his arms on the armrests. In general, the seats have two armrests, however variants with only one armrest are known.

This basic form of the seat has a wide range of variations. Known variations are upholstered armchairs as the low extreme and high seats, for example at a bar. Other special forms are, for example, dentists' chairs and seats intended for children. For small children, there are a multiplicity of seating means, which are similar, for example, to a chair for adults, which is only adapted to the size of the child in its proportions. In many cases, however, other specialized seats are used, such as high seats, on which very small children can sit at a table that is actually too high for them, or the variety of seats in pushchairs or the safety seats in motor vehicles. Furthermore, seats intended universally for persons of different sizes are made into a seat suitable only for children by means of additional fittings, such as seat covers and/or arm rests.

Such seating means exist in openly accessible areas, such as taxis, supermarket carts or swimming baths, which may be soiled by the widespread use by the wide variety of infants, so that the child is protected against this contamination by means of a seat cover.

Another reason for the application of seat covers is that the small child itself can be responsible for the soiling of the seat. They are objects that are first picked up by children and then dropped and from which parts can detach by contact with the hands or teeth. Small children can often not completely take in their food, so that parts drop down, which can soil the seating means. A particularly intensive contamination is caused by metabolic products that the child excretes.

Although diapers are usually applied to the children to catch them, it cannot be entirely ruled out that a portion emerges around the diapers.

For this reason, it is normal in residential areas to produce seating means for children from very hard materials with smooth surfaces, such as, for example, lacquered wood. These are relatively robust and can be easily cleaned, however, they are not economically adapted to the child's buttocks and back. As a result, spotwise overstressing of the hip joint and spinal column occur, which can lead to early restlessness of the child.

A further disadvantage is that, due to areal contact between the child's skin and the hard surface of the seating means, transpiration of the skin surface is increased, which in an extreme case leads to reddening of the stressed skin portions, and therefore to further restlessness of the child. The example of the seat in motor vehicles intended especially for children shows that upholstering is inescapable for relatively long sitting.

In the prior art, U.S. Pat. No. 5,678,888, Sowell, describes a seating means cover that serves for covering a seat for small children, which can be folded out from the back wall of supermarket carts. The seat cover consists of a thin textile material that lies flat on the seat surface and from there extends vertically upwards, so that a box-like shape is produced. In the forwards-facing surface of this box-like shape, two openings for passing through the child's legs are provided. This seat cover is primarily intended to keep the child away from existing soiling of the seat surface and of the lateral delimitations. Thanks to the openings in the front surface, however, it is not suitable for warding off soiling emerging from the child. The seat cover also does not offer possibilities for supporting the seating of the child in an economically appropriate way or adapting the temperature of the seat surface to a skin-friendly degree, or ventilating the seat surface.

These restrictions also apply to JP 2003 235 690, Mac Sanko, which describes a bag-like inlay for an infant shell. This is not only intended for shells in which the infant lies primarily horizontally, but also for shells that permit a straightening up of the back area. In addition to the aforementioned restrictions, this seat cover also lacks the formation of separate regions for the back portions, the armrests and the leg region. As a result, a lasting adaptation to the respective shape of the seat is not possible. Rather, due to the regular movements of the infant, wrinkles form, which permanently overstress the child's skin. Another restriction is that that seat cover is partially laid on the child, and is restricted in its freedom of its movement, which can lead to an uneasiness of the child.

Against this background, it is the object of the invention to develop a seat cover for seating means, which can be universally adapted to various forms and manners of seat, which can protect the seated person against soiling of the seat and the seat against soiling by the seated person, and is equipped with additional equipment which improve the ventilation, the temperature control and the ergonomic adaptation of the seat, and also performs other functions.

As a solution, the invention teaches that a quadrangular seat surface can be placed on the seat, wherein the first edge of the seat surface is connected to a back portion, on which a backrest hood is formed, which can be pulled over the back rest, and the second edge and fourth edge of the seat surface lying opposite each other are each connected to one armrest portion, wherein each armrest portion can be paced on an armrest, and the third edge of the seat surface is connected to a foot portion, which can be suspended over the front edge of the seat.

Every seat that can be equipped with a functional seat cover according to the invention consists of an approximately horizontal seat, on which the buttocks of a person rest. A backrest is adjoined on one edge of this seat and an armrest in each case on the two adjacent edges. The sitting person rests his back against the backrest and can rest his arms on the armrests. In general, the seats have two armrests, however variants with only one armrest are known.

Based on from this basic form, all conceivable variants of a seat are expressly included. From an upholstered armchair as the low extreme through to a high seat, for example at a bar. Also included are special forms, such as folding seats, hall seating with broadened armrests as writing surface, toilet chairs, office chairs, dentist's chairs and seats intended for children.

In all cases it is the basic idea of the invention that a seat cover is provided that, though in one part, can, through separate development of the other functional areas that are not necessarily associated with the pure sitting on a surface, namely resting of the back, resting of the arms and contact or resting of the feet, also be adapted at various sizes and proportions by rapidly changing seating means.

Due to its low material thickness, it hardly influences the ergonomic conditions of the seat and, at the edge regions of backrests and armrests, can be easily drawn around the corners thereof and even stretched if so desired. The low material thickness is also advantageous if the functional seat covering is to be taken off and stored. Due to its relatively low volume, it can be easily washed, for example by placing in a washing machine.

The simple and clear form permits easy manufacturing, for example by cutting out of a large fabric web and stitching of the edges. In the simplest case, a single, approximately cross-shaped portion is cut out, a strip of the back portion is folded and sewn at the edges of the back portion in order to form the backrest hood. Depending on the material, the other edges are hemmed.

This relatively simple shape also permits a large variety of optical designs. They extend from the selection of a printed fabric to the application of decorations to the individual surfaces by embroidery or the sewing on of other decorative elements.

A very large variety of textile materials can be used: A production from one-layer cotton fabric or single-ply, robust plastic material is possible, as is the use of a plurality of layers, predominantly of textile material. Very interesting is, for example, a two-layer design, in which a lower layer is water impermeable and thereby acts as a barrier to moisture emerging from the child or, when used as hygiene protection, keeps back fluids present at the outside. The upper layer can consist of a particularly skin-compatible, soft and deep-pile material, for example terry cloth.

For a simple adaptation to various distances of the posts from backrests and armrests, diagonal slits emerging from the corners of the seat surface are suitable, which enclose posts standing close together. The other region of the slit can be closed, for example by means of a hook-and-loop fastening.

To equip the functional seat covering according to the invention with the functionalities according to the object, and to allow it to be quickly and easily exchanges as required, the invention provides for pockets on the individual surfaces as an alternative embodiment. The seat surface, the back portion, the armrest portions or the foot portion can each be equipped with at least one pocket, which serves for inserting functional elements.

The invention proposes upholstery elements for adaptation to ergonomic requirements. Thanks to upholstery elements in the seat region, the spotwise overstressing of the child's hip joints, in particular in the case of a flat and hard seat, can be avoided. With the removal of this disadvantage, the child will then remain on the seating means for longer and with greater calmness.

It is appropriate to provide cooling elements or heating elements for controlling the child's temperature. In the simplest case that can be a gel-filled, flat bag which is brought to the desired temperature in the refrigerator on a radiator. In a refinement, it is conceivable that, by means of peltier elements, the elements are cooled on one surface and heated on the other surface by means of electrical energy. The cool side faces the child in summer, and the heated side in winter.

It is also conceivable that, for temperature control, a knitted spacer fabric is used, through which cooled or heated air is blown. The channels for the supply and for the removal of air can be sewn onto the cover and also consist of textile material, so that the completely equipped covering can still adapt to the shapes of the respective seating means.

However, the aforementioned knitted spacer fabric can also be used without forced air supply just to improve the ventilation. It permits air supply, particularly in the seat region. In the case of children who perspire relatively strongly, the moist air is thereby removed much better. Impairments or even injuries to the skin by this moisture is thereby avoided. Another advantage is that, in the case of a suddenly occurring, intensified ventilation of the air-body parts moistened with sweat—for example on lifting the buttocks—the stressing is reduced or even eliminated by the excessive cooling that suddenly occurs.

The other functions of the elements that can be inserted in the pockets are not only a relatively luxurious equipment feature, but alleviate particular overstressing, as a result of which the probability of expressions of annoyance by the child are reduced.

As already mentioned, a disadvantage of a multiplicity of known proposes for seat covers of children's seats is that they are not tightly stretched with respect to the seat surface, the backrest or the armrests, and thereby form wrinkles which can unduly stress the child's skin. To avoid this wrinkling, the invention proposes that, at the end of at least one armrest portion or of the footrest portion, weights are applied, which stretch the textile material smoothly by the effect of gravity. Such a weight may be, for example, a lead chain, a rod or a different, weighty bulk material in a hollow seam at the end in each case. Alternatively, a weight can also be inserted and/or fastened into one or more small pockets at the end of an armrest portion or at the end of the foot portion. For this variant, a further, suitable complement is that the seat surface is, in the region of its edges, joined via additional fastening elements to the seat to be covered.

As a further embodiment, the invention proposes that the foot portion can be formed into a foot muff by joining the end of the foot portion to the front corners of the seat surface or to the forwardly facing edges of the armrest portions. To this end, as fastening elements, elongated textile strips can be used, which are sewed, for example, on the corners of the seat surface.

For an improved adaptation to seats of different sizes, the invention proposes as alternative that a plurality of loops are mounted in each case, in the region of the four corners, on the underside of the seat surface of the cover, with different distances from the corners. Depending on the size of the seat to be covered, the loop closes to the actual seat size is chosen as fastening point for the textile strip. By this means the seat surface of the covering can be tautly stretched on the seat. The textile strips are then looped around the legs of the seating means, around struts of the armrests or of the backrests and, for example, closed with a loop or a hook-and-loop fastening to form a tautly conforming ring.

By means of these multiple fastening options, the functional seat covering can be used both on relatively small as well as on relatively very large seats. It is also possible to lay the covering on different seats within one day, that is to say from the high chair in the apartment after breakfast to the child's seat in the car in the morning to the child's seat in the kindergarten and in the afternoon to the pushchair for a stroll.

In functional elements are inserted into the pockets on the covering, they, too, must also be adaptable to the changing sizes. For this, the invention proposes that, for example for the seat surface, a rectangular pocket is provided approximately in the centre, which leaves the edge regions of the seat surface free. In these edge regions, further elongated pockets are provided, into which appropriately smaller functional elements can be inserted. During use of a very small seat, only the pocket in the centre is equipped with a functional element; the edge pockets remain free. If the functional seat cover is placed on a relatively large seat, the narrow pockets in the edge region are also equipped.

As mentioned, a significant feature of the functional seat cover according to the invention is that it is fixed by means of a backrest hood on the backrest of the respective child's seat. Since the length of the backrests of the various seating means can be extremely different, the invention proposes that the functional seat cover is dimensioned for the greatest occurring length of the backrest. For shorter backrests, a particular horizontal section in the back portion of the cover is gathered up by folding on itself and "folded away". It is in the interest of a wrinkle-free resting that the fold edge of the folded-away section is fixed, for example by corresponding fastening elements. These fastening elements can—as described above—be introduced into one of a plurality of available openings. Alternatively, a hook-and-loop fastening can be pressed at the suitable place in each case.

The already repeatedly mentioned fastening elements can be fastened at the seat surface, the back portion, at least one armrest portion or the foot portion. Besides the aforementioned flexible elongated strip, cords, chains, strings or braids are also conceivable. These fastening elements can either be closed to form a ring or inserted, hooked or snap-fitted into complementary counterparts on the covering—for example by means of press studs. Other fastenings that are very easy to handle are hook-and-loop closures. If the fastening elements are not connected together, for example, by means of a knot or a loop, then as connecting elements, hooks, hook-and-loop fastenings, buttons, press studs, buckles, slits, hollow rivets or the like are provided. These counterparts are either arranged at the respective other end of an elongated strip-like fastening element or on the seat surface or a portion of the covering. Here, it is appropriate to always arrange the fastening elements in pairs in each case.

For adaptation to seating means of different sizes, it is also appropriate for a plurality of fastenings to be arranged at a small spacing from one another. Depending on the size of the seat to be covered, the nearest fastening element in each case is then used. The fastening element disposed at the outermost then serves to fix the respective overhanging regions of the covering at a suitable place.

Another appropriate extension of the functional seat covering according to the invention are horizontal surfaces stretched at the edge, which receive objects dropped by the child and thereby prevent them from falling onto the floor or even from rolling beneath other furniture objects.

Those ends of the armrest portion that freely hang down can be used for this purpose. To stretch them to form a horizontal surface with the least possible effort, the invention proposes—in a similar way to an umbrella—to hold them in position by means of two-rod-shaped struts. These two struts are inserted into hollow seams on the two opposite free edges of the armrest portions. They then run from one armrest portion to the other armrest portion above and approximately parallel to the seat surface. By this means, they rest on the respective upper edge of the two armrests and span, in the manner of a bridge, the region between the armrests.

In this region, the rear strut can be guided through a corresponding recess in the back portion, so that it does not obstruct the child's back. The other strut, running parallel thereto, can run along the edge of a table for the child. Alternatively, on this strut, there can also be mounted a table, which also rests on the two armrests. This additional table extends the range of the stretched surfaces around the child, so that, with full equipment around the child, a wide, approximately U-shaped, horizontal strip extends around the child, which can be used in the manner of a table to receive objects that appeal to the infant.

To adapt to different dimensions of the seating means, a plurality of recesses for the rear strut can also be provided, on which only one is used. Likewise a plurality of hollow seams can also be provided on the armrests, so that the stretched regions can also be adapted to the respective length of the armrests.

Alternatively to a table, the horizontal surface extended around the child can also be formed by the end piece of the foot portion. To this end, the end of the foot portion can be guided upwards around the feet in the manner of a foot muff. Here, it is held by struts which for one half run in narrow tunnel-like pockets on the armrests and for the other half run in hollow seams at the edge of the foot portion. By this means a surface, which runs around the child in a U-shape and consists of textile material in the manner of the roof of a tent, is created, which is stretched at intervals by means of struts.

Further details and features of the invention are explained below in greater detail with reference to examples. However, they are not intended to limit the invention but only explain it. In schematic, view:

FIG. 1 shows a section through a child's seat cover on a seat

Figure 2:
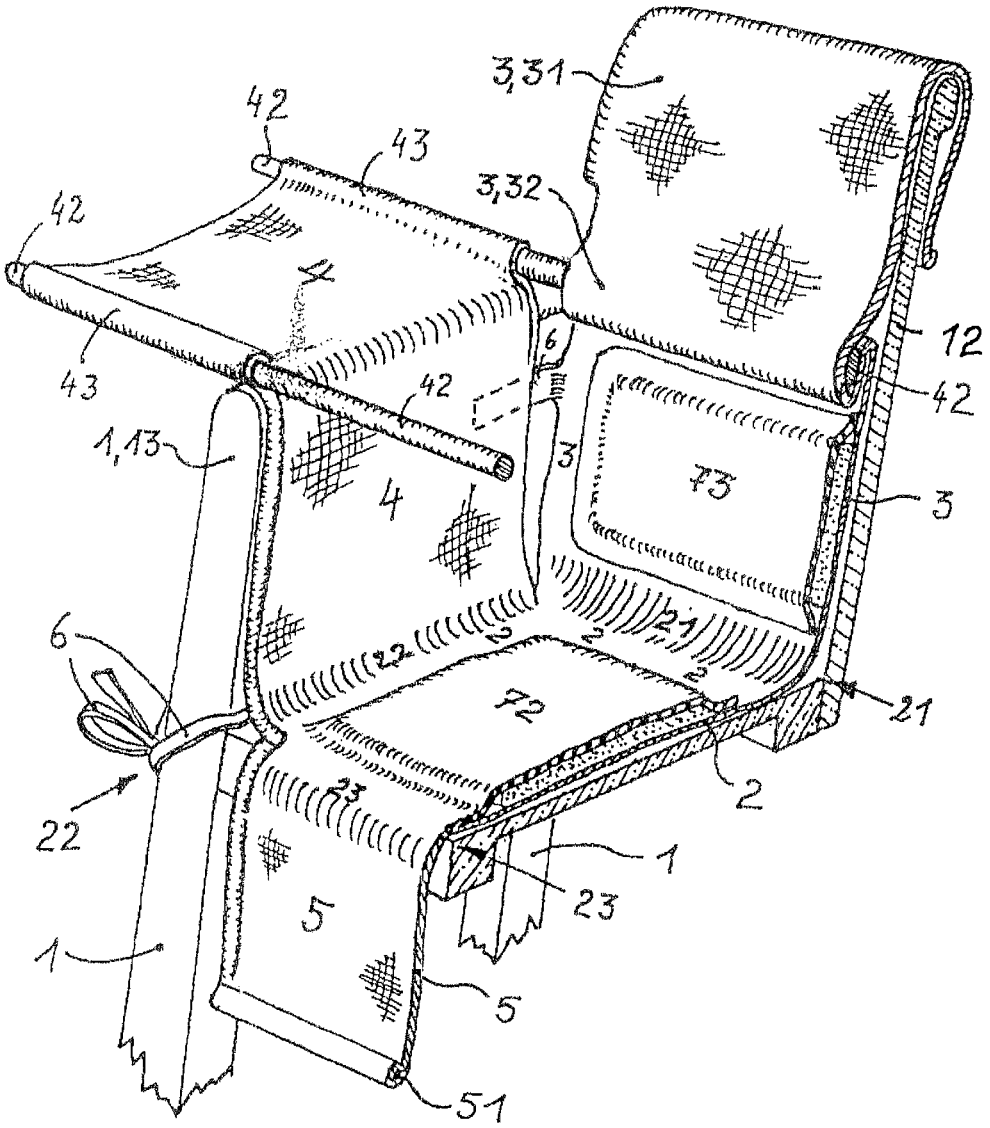

FIG. 2 shows a section as in FIG. 1, but with an arm portion stretched as shelf surface In FIG. 1 a seating means for children is provided with a cover according to the invention and is diagrammatically cutaway in the centre from the backrest to the front edge. Likewise, the legs of the seating means 1 are diagrammatically broken off. The seat 11 of the seating means 1 can be seen in section.

The panel of the seat 11 is reinforced at the edges by a crossbar in each case an, at the rear edge, is contiguous with the backrest 12 of the seating means 1. The central element of the covering, the seat surface 2, lies on the seat 11. In FIG. 1, it is shown diagrammatically cut in half. The first edge 21, which joins the seat surface 2 to the back portion 3, can only be seen as one half. The back portion 3 lies on the backrest 12 of the seating means 1 and, at its top end, is mounted on the backrest 12 by means of the backrest hood 31.

In the embodiment shown, a comparatively very short backrest 12 is drawn. In this embodiment, the back portion 3 of the covering is too long therefor. It is therefore gathered together approximately in its centre in a horizontal section 32. The gathered together portions are folded onto one another. In FIG. 1, it is not shown how the gathered together portions are stably connected to the adjacent region by means of fastening elements—such as a hook-and-loop fastening.

In FIG. 1, as a result of the extremely great material thickness in the illustration, the folded together, horizontal section 32 appears as a very much more voluminous object than will be the case in practice. However, it can be clearly seen how, in this manner, the length of the back portion 3, can be adapted to the respective length of the backrest 12 of the seating means 1.

The armrest 4 is mounted at the, in FIG. 1, left side of the seat surface 2, at the second edge 22. In the drawn exemplary embodiment, it merges integrally into the seat surface 2. In FIG. 1 it can be readily seen how the armrest portion 4 is guided along the armrest 13 of the seating means 1, upwards as far as the upper edge. At the other side, the free end of the armrest portion 4 hangs down. In the illustrated embodiment, a hollow seam is applied at the end of the armrest portion 4, in which a weight 41 is inserted, in this case, for example, an approximately cylindrical rod. This weight, due to its gravity, keeps the armrest portion 4 taut, so that wrinkles that are troubling for the infant are not formed.

On the front side of the seating surface 2, the third edge 23, the foot portion 5 of the cover is attached. In FIG. 1 it is readily apparent how it hangs out freely beyond the front delimation of the seat surface 2. At its end, it is kept taut in a similar way to the arm portion by a weight 51. This weight prevents the foot portion 5 from becoming caught or jammed between the seat surface 2 and the seat 11.

At the left-hand side of FIG. 1, it is shown how, with a tape-like fastening element 6, the cover is fastened to the armrest 13 at the connecting point of the seat 11. The two ends of the fastening element are guided around a front, column-like portion of the armrest 4 and joined together to form a loop.

In FIG. 1, another variant of a fastening element 6 is illustrated, namely at the connection of the back portion 3 to the armrest portion 4. In this example, a textile strip is sewed on the back portion 3 and joined to a hook-and-loop fastener on the outside of the armrest portion 4.

As a further equipment variant, the seat surface 2 and back portion 3 in FIG. 1 are equipped with a pocket 72 and 73 in each case. Various functional elements can be inserted in this pocket, which improve the conditions for accommodating the child. In FIG. 1, in cross-section, a dotted cutaway surface of the contents of the two pockets 72 and 73 is shown. For example, a cushion, a spacer knitted fabric or a gel cushion, with which the seat surface and back can be heated or cooled depending on the preliminary temperature adjustment. In FIG. 1, it is clear that an electrical heating element could be inserted into the pockets, or a peltier element, which uses electrical energy directly for cooling.

In FIG. 2, the same seating means 1 as in FIG. 1 is illustrated with the same section. The difference from FIG. 1 is that that portion of the armrest portion 4 of the covering that hangs down over the armrest 13 is stretched to form an approximately horizontal shelf area. In FIG. 2, it can be readily seen how, therefor, a strut 42 in in each case is inserted into hollow seams 43 at the edges of the arm portion 4. This strut 42 lies on the upper edge of the armrest 13. The rear strut 42 is guided along behind the back portion of the covering 3 so that the back portion cushions somewhat the strut 42 projecting beyond the backrest 12; in practice, the bead formed thereby is not always as large as in FIG. 2, since a correspondingly folded-together, horizontal section 32 of the back portion 3 is shown, which comes to lie at the same level as the pass-through of the strut 42.

In FIG. 2, it is clear that the front strut 42 lies within reach of the child. It is therefore a readily apparent step, in a further refined variant—but which is not shown in FIG. 2—to also provide the strut 42 with a horizontal shelf surface, such as, for example, a table or, in a similar way to the armrest, an upwardly folded end of the foot portion 5. For this variant, the foot portion 5 must be very long, since it extends downwards as far as the feet of the seated child, and from there must be guided back fully upwards as far as the strut 42. If it is also to be stretched there to form a horizontal shelf surface, a further extension of the foot portion 5 is necessary for this.

LIST OF REFERENCE CHARACTERS

1 Seating means for children
11 Seat of the seating means 1
12 Backrest of the seating means 1
13 Armrests of the seating means 1
2 Seat surface of the covering, lying on seat 11
21 First edge of the seating surface 2, connected to the back portion 3
22 Second edge of the seating surface 2, connected an armrest portion 4
23 Third edge of the seating surface 2, connected to the foot portion 5
3 Back portion of the covering
31 Backrest hood of the back portion
32 Horizontal section of the back portion 3, can be gathered together
4 Armrest portion of the covering
41 Weight at the end of the armrest portion
42 Strut, stretches the armrest portion 4 into a horizontal shelf
43 Hollow space on the armrest 4 for inserting the strut 42
5 Foot portion of the covering
51 Weight at the end of the foot portion
6 Fastening element on the seat surface 2 or portions 3 to 5
72 Pocket on seat surface 2
73 Pocket on back portion 3

The invention claimed is:

1. A functional seat cover for placing on a seating for children, which includes an approximately horizontal seat, an approximately vertical backrest, and two armrests, the functional seat cover composed of washable textile material and comprising:

a quadrilateral seat surface configured to be laid on the seat, which is connected at its first edge to a back portion, on which a backrest hood is integrally formed, which can be drawn over the backrest, and the seat surface is connected at its mutually opposite second edge and its fourth edge to an armrest portion in each case, which in each case can be laid on an armrest, and the seating surface, at its third edge, is connected to a foot portion, which can be hung down over the front edge of the seat;

wherein:

the washable textile material comprises two or more layers of textile material including a lower water-impermeable layer and an upper high-pile layer;

each armrest portion includes a pair of opposing free edges, each free edge including a hollow seam;

the functional seat cover further comprises a pair of struts, each strut received within one of the hollow seams of each armrest portion; and each armrest portion is stretched between the struts to form an approximately horizontal shelf surface that is above and approximately parallel to two edges of the seat surface.

2. The functional seat cover according to claim 1, wherein the seating surface, the back portion, at least one armrest, and/or the foot portion is equipped with at least one pocket in which a three-dimensional knitted spacer fabric;

an upholstery element;

a cooling element; and/or a heating element is inserted.

3. The functional seat cover according to claim 2, wherein the seat surface has, approximately in the center, a rectangular pocket, which is surrounded at least one edge by a plurality of narrow, strip-like pockets.

4. The functional seat cover according to claim 1, wherein at an end of at least one armrest portion and/or an end of the foot portion, a weight is attached.

5. The functional seat cover according to claim 4, wherein the weight comprises:

a lead chain;

a rod; or a bulk material;

in a hollow seam.

6. The functional seat cover according to claim 4, wherein the weight can be inserted into a pocket at an end of the armrest portion or at an end of the foot portion.

7. The functional seat cover according to claim 1, wherein the distance between the seat surface and an upper edge of the back portion can be adjusted by gathering together and fixing a horizontal section of the back portion.

8. The functional seat cover according to claim 7, wherein, for fixing the gathered-together section of the back portion, a fastening element can be used.

9. The functional seat cover according to claim 1, wherein, on the seating surface, the back portion, at least one armrest portion, and/or the foot portion, flexible, elongated fastening elements selected from the group consisting of cords, strips, chains, strings, or braids are fastened, wherein the fastening elements are configured to connect the seat surface, the back portion, the armrest portion, and/or the foot portion to the seating.

10. The functional seat cover according to claim 9, wherein the fastening elements are in each case fastened in pairs at a small distance from one another or at the same location of the functional seat cover.

11. The functional seat cover according to claim 9, wherein the fastening elements can be guided around portions of the seating and can be joined to themselves, to a further fastening element, and/or to the functional seat cover.

12. The functional seat cover according to claim 9, wherein the fastening elements are connected to one another by means of a knot or a loop.

13. The functional seat cover according to claim 9, wherein each of the fastening elements are connected to one another, to the seat surface, to the back portion, the armrest portion, and/or to the back portion by of a hook, a hook-and-loop closure, a button, a press stud, a buckle, a slit, and/or a hollow rivet.

14. The functional seat cover according to claim 1, wherein, for adaptation to various sizes of the seating, a plurality of fastening means are disposed close to one another, and only one or a few thereof are equipped with a fastening element.

15. The functional seat cover according to claim 1 wherein one of the struts extends through a narrow, horizontal tunnel-like pocket in the back portion.

16. The functional seat cover according to claim 15, wherein, for adaptation to different dimensions of the seating, a plurality of tunnel-like pockets are available.

17. The functional seat cover according to claim 1 wherein an end portion of the foot portion is configured to can be stretched to form an approximately horizontal shelf surface, in which a strut extends through narrow, tunnel-like pockets of the foot portion and the armrest portion.

* * * * *